US005653295A

United States Patent [19]

Juvonen et al.

[11] Patent Number: 5,653,295

[45] Date of Patent: Aug. 5, 1997

[54] HYDRAULIC PRECUSSION HAMMER

[75] Inventors: Esko Juvonen; Jouni Salo, both of Lahti; Kauko Juuri, Hollola, all of Finland

[73] Assignee: Bretec Oy, Lahti, Finland

[21] Appl. No.: 490,774

[22] Filed: Jun. 15, 1995

[51] Int. Cl.[6] ..... B25D 9/14

[52] U.S. Cl. ..... 173/208; 173/207; 91/300; 91/303

[58] Field of Search ..... 173/206, 207, 173/208, 17, 137, 138; 91/290, 300, 303

[56] References Cited

U.S. PATENT DOCUMENTS

| | | | |
|---|---|---|---|
| 4,474,248 | 10/1984 | Musso | 173/208 |
| 4,817,737 | 4/1989 | Hamada et al. | 173/207 |
| 4,858,702 | 8/1989 | Piras | 173/208 |
| 4,899,836 | 2/1990 | Venot | 173/207 |
| 5,064,005 | 11/1991 | Krone | 173/208 |
| 5,392,865 | 2/1995 | Piras | 173/208 |

FOREIGN PATENT DOCUMENTS

| | | |
|---|---|---|
| 0214064 | 3/1987 | European Pat. Off. . |
| 50390 | 3/1975 | Finland . |
| 2852/74 | 4/1975 | Finland . |
| 760672 | 9/1976 | Finland . |
| 72908 | 12/1980 | Finland . |
| 870495 | 9/1987 | Finland . |
| 92477 | 4/1988 | Finland . |
| 2305279 | 10/1976 | France . |
| 2726046 | 12/1977 | Germany . |
| 2710561 | 9/1978 | Germany . |
| 2054751 | 2/1981 | United Kingdom . |

*Primary Examiner*—Scott A. Smith

*Attorney, Agent, or Firm*—Smith-Hill and Bedell

[57] ABSTRACT

The invention relates to a hydraulic percussion hammer comprising a piston (1), a pressure accumulator (7) in the high pressure circuit, a main valve (8) alternately conducing a high and low pressure to at least one of the pressure surfaces (2,4) of the piston (1) for making the piston (1) move reciprocally, and a tool (3) which the piston (1) strikes, and, for the purpose of controlling the main valve (8), a control pressure valve (9) which opens when the pressure exceeds a set value. According to the invention, the control pressure valve (9) is placed in such a way that the spindle (27) of the control pressure valve (9) is connected from one end to the high pressure circuit of the hydraulic percussion hammer. Furthermore, for the purpose of adjusting the maximum and minimum operating pressure of the hydraulic percussion hammer the other end of the spindle (27) of the control pressure valve (9) comprises a control space (29) connected through the hydraulic ducts to at least two pressure control devices (30,31,32,33) connected hydraulically in parallel or in series.

27 Claims, 2 Drawing Sheets

HYDRAULIC PRECUSSION HAMMER

Figure 1:
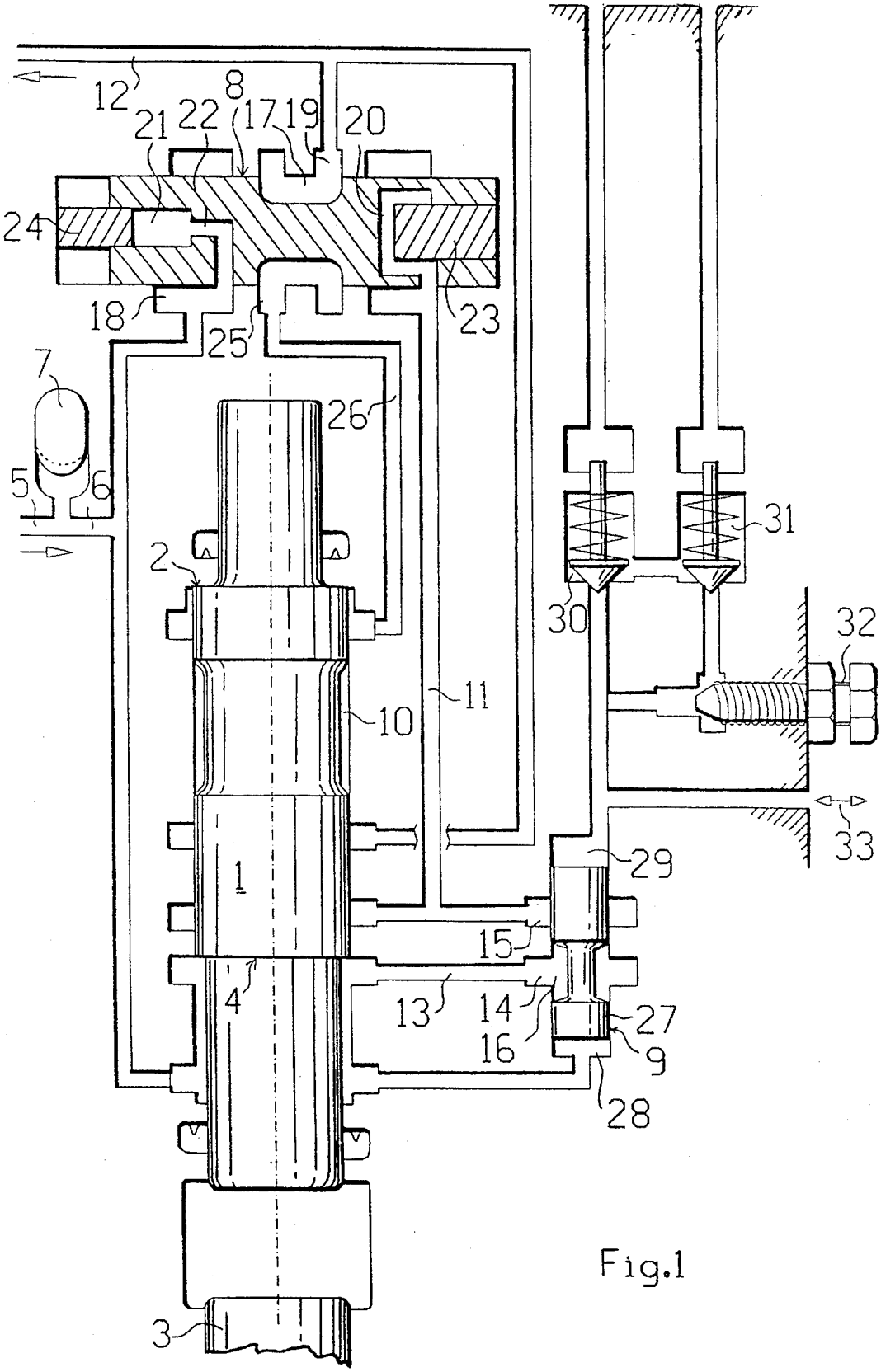

The invention relates to a hydraulic percussion hammer the power of which can be adjusted within a substantially wide volume flow range of hydraulic fluid.

A hydraulic percussion hammer comprises a hydraulically reciprocating piston delivering consecutive blows, through a tool, on the object to be worked. The object of the blows may be of stone, concrete, asphalt, frozen soil, or the like. A hydraulic percussion hammer may preferably be attached to substantially all machines utilizing hydraulics, for example earthmovers. A percussion hammer may also be used as a percussion mechanism of a rock drill, and for example in pile driving and tamping work. Below a basic machine refers generally to a machine utilizing hydraulics and comprising an associated hydraulic percussion hammer.

Conventional percussion hammers operate within a narrow volume flow range of hydraulic fluid, and therefore the possibility of varying the stroke frequency, which refers to the number of blows delivered per time unit, remains small. A wide volume flow range is advantageous when the same percussion hammer is to be used for different kinds of breaking work and especially in hiring when the percussion hammer is mounted in different basic machines and the adjustments have to be changed often. The operating pressure of the percussion hammer affects the impact energy of the hammer. The operating pressure is usually controlled with a throttle or a pressure control valve placed in the return line of the percussion hammer, or in hammers operating on a so-called piston/accumulator principle, with the gas pressure of the accumulator. The drawback with these methods of adjustment is the great variation in the operating pressure when the volume flow changes. In general, the manufacturers of percussion hammers adjust the hammers to provide the correct operating pressure with the maximum volume flow. When a percussion hammer is mounted in a basic machine providing a minimum volume flow, the operating pressure falls even as much as 20%. If the operating pressure is now adjusted to the correct level in this basic machine, but the percussion hammer is then operated in another basic machine with the maximum volume flow, the operating pressure of the hammer is exceeded by about 20%, which may result in a premature deterioration or breakdown in the percussion hammer. Furthermore, the operating pressure also changes in different basic machines, depending on the size of the hydraulic piping, and other hydraulic resistances. In breaking work where the hammers are mainly used, there is often a need to diminish the impact energy provided by the percussion hammer for example when soft material is broken, or due to the shaking of the soil and the buildings caused by the blows.

Different adjustments have been built in hammers previously, and even self-adjusting devices have been provided. However, these systems of adjustment do not eliminate the aforementioned problems, but the volume flow range available with each adjustment value remains narrow, and the operating pressure of the percussion hammer changes considerably when the volume flow is altered. In some devices the impact energy is adjusted by changing the stroke length of the piston. However, the stroke frequency of the percussion hammer also changes then, so that when maximum impact energy is used, maximum stroke frequency can no longer be reached.

Impact energy is usually adjusted by diminishing the impact velocity of the piston, i.e. the speed the piston has reached before it strikes the tool head. When the impact is targeted on hard material, such as hard rock or metal, and the tool does not penetrate the material, the piston rebounds from the upper surface of the tool at a speed proportionate to the impact velocity. The valves controlling the piston are timed in such a way that the return movement of the piston is smooth. The valves can usually be timed well with a certain impact velocity and within a certain volume flow range, but if the impact velocity is changed by more than 10%, timing problems may occur between the valves and the piston, causing for example cavitation and asynchronous movement of the piston. Such problems are prevalent especially in hammers where the operating pressure is adjusted with flow resistances in the return conduit.

Finnish Patent 50,390 discloses a hydraulically driven percussion device wherein the pressure of a variable pressure cylinder space is adjusted with a sleeve-like distribution means placed to encircle the piston and a minimum pressure valve fitted in the body of the percussion device. In this percussion device the minimum pressure valve is adjusted to open only when the pressure in the high pressure duct reaches a desired value. The impact movement of the piston may then begin only if the piston is in its extreme position farthest from the tool, and the minimum pressure valve both feeds the pressure medium to the variable pressure cylinder space and acts as the control valve for the sleeve-like distribution means. According to Finnish Patent 50,390, it is thus possible to adjust only the minimum operating pressure of the percussion device.

The purpose of the present invention is to eliminate the prior art disadvantages and to provide an improved hydraulic percussion hammer wherein the operating pressure of the hammer can be adjusted either to a predetermined minimum or maximum operating pressure or continuously between them, and wherein the pressure can be maintained at a substantially constant level within a substantially wide volume flow range. The preferred characteristics of the invention are disclosed in the appended claims.

According to the invention, maximum and minimum operating pressures are adjusted in the percussion hammer by means of pressure control devices, the pressures determining the maximum and minimum impact energy. For the purpose of controlling the main valve, the percussion hammer according to the invention comprises a control pressure valve, which opens when the pressure exceeds a set value. The control pressure valve is placed in the percussion hammer in such a way that the spindle of the valve is connected from one end to the high pressure circuit of the hydraulic percussion hammer, and the other end of the spindle comprises a control space, which is connected to at least two pressure control devices through the hydraulic ducts, for adjusting the maximum and minimum operating pressure of the hydraulic percussion hammer. The percussion hammer also comprises a control device which is used to select either the maximum or minimum impact energy. Continuous control can be provided between them, if necessary, by means of remote control devices. These remote control devices, like the other pressure control devices and means used in the percussion hammer according to the invention, are preferably normal hydraulic control devices, such as shut-off valves, decompression valves, throttles, or proportional and servo valves. Furthermore, at least one of the pressure control devices is installed in such a way that in addition to the pressure control force of the pressure control device itself, its opening is also regulated by the atmospheric pressure outside the percussion hammer.

With the arrangement according to the invention the impact energy remains substantially constant when the volume flow is changed or when the percussion hammer is mounted in different basic machines having varying hydraulic resistances in their pipe systems. The stroke frequency of the percussion hammer is controlled in a simple manner by adjusting the volume flow fed into the percussion hammer. In the device according to the invention it is possible to separately adjust the impact energy and stroke frequency of the percussion hammer, which is useful in breaking up different materials and installing the same percussion hammer in different basic machines for example in hiring.

The arrangement according to the invention also attenuates possible great temporary variations in pressure and the oscillatory acceleration of the piston in the impact direction when the main valve opens the high pressure onto the upper shoulder of the piston. Even though the operating pressure is fixed to a constant value, the impact energy still varies slightly with different volume flows, since as the piston moves in the impact direction the high-pressure accumulator is discharged more with small volume flows and the pressure on the upper shoulder of the piston drops lower than with large volume flows. This attenuation is provided with a brake in the upper end of the piston, the brake limiting the flow of hydraulic fluid to the upper shoulder in the beginning of the movement. By means of the hydraulic brake of the piston's upper end, the hydraulic fluid flow in the upper shoulder of the piston can also be throttled when the piston moves upwards. The braking space formed in the upper end of the piston is thereby effective when the piston moves both up and down.

The arrangement according to the invention also provides the heating circulation of the percussion hammer, which refers to eliminating the differences in temperature between the hydraulic fluid and the percussion hammer, or warming up the hammer before the work is started for example at subzero temperatures. If the hydraulic fluid of the basic machine has heated up for example during a long drive and the cold percussion hammer is started, a dangerous situation occurs and the percussion hammer may be broken due to the small clearances and sudden heat expansions of the moving parts. This can be prevented with a heating circulation where the hydraulic fluid circulates through the percussion hammer at a pressure lower than the minimum pressure, whereupon the percussion hammer does not strike. The circulation is preferably provided through the control line by circulating the hydraulic fluid through the conduit leading to the control space of the control pressure valve.

Figure 2:
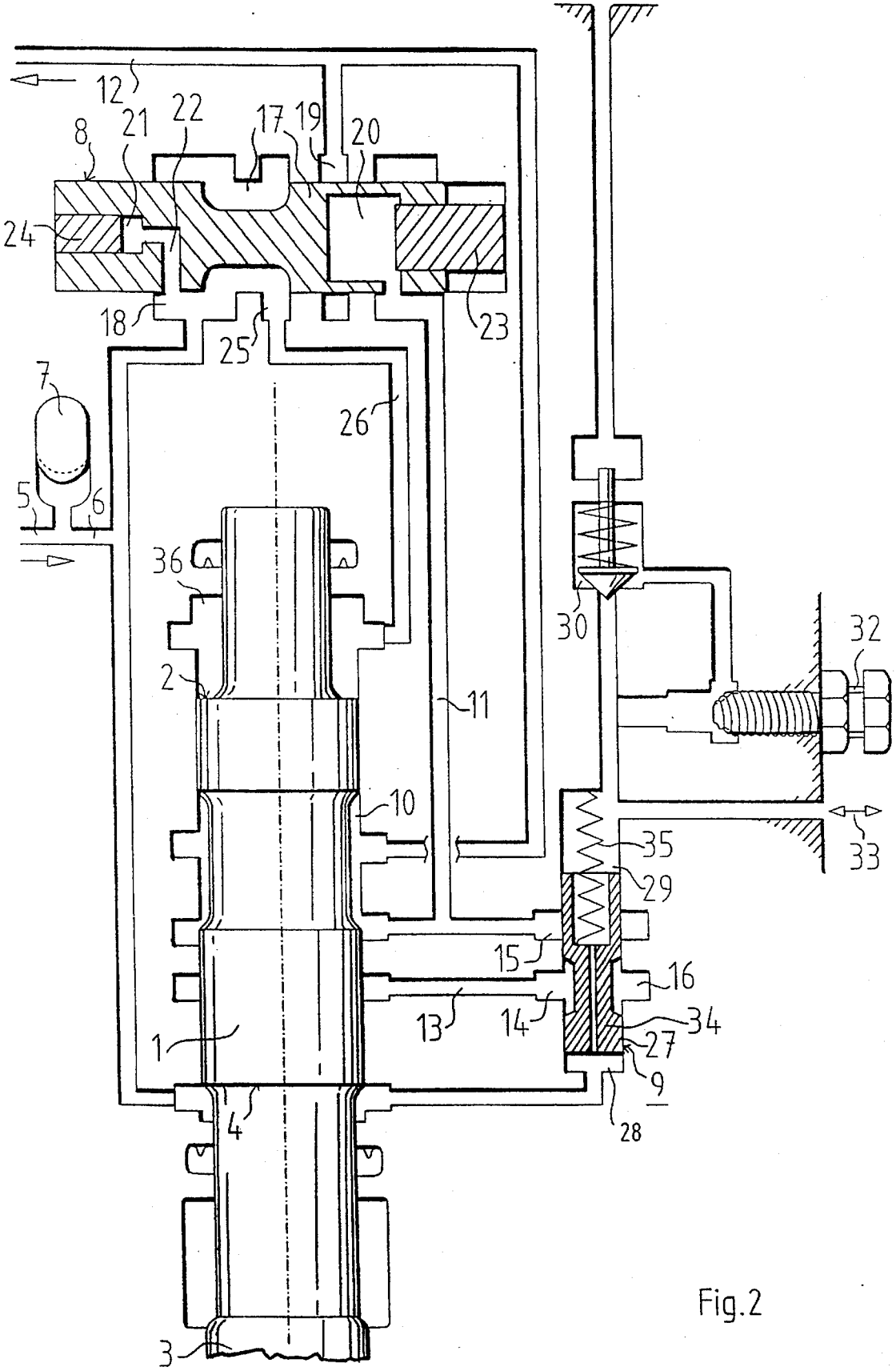

In the following, the invention will be described in greater detail with reference to the accompanying drawings, in which FIG. 1 presents schematically, in partial longitudinal section, a preferred embodiment of the invention, and FIG. 2 presents schematically, in partial longitudinal section, another preferred embodiment of the invention.

According to FIG. 1, the piston 1 comprises an upper shoulder 2 with an annular surface. When pressure acts on this shoulder the piston accelerates downwards towards a tool 3. The piston 1 also comprises an annular pressure surface, a lower shoulder 4, active in the reverse, i.e. return direction. The lower shoulder 4 has a smaller area than the upper shoulder 2. An inlet port 5 for hydraulic fluid supplies the percussion hammer with a high pressure connected through the ducts 6 directly to a high-pressure accumulator 7, the lower shoulder 4 of the piston, a main valve 8 and a control pressure valve 9. The centre of the piston comprises a guide groove 10, which connects the control pressure duct 11 of the main valve to the outlet line 12 of the percussion hammer when the piston is in the lower position. When the piston is in the upper position, the high pressure from the lower shoulder is connected to a duct 13 leading to a groove 14 in the control pressure valve 9. Depending on the position of the control pressure valve 9, a groove 16 in the spindle may open a connection from the groove 14 to another groove 15 leading then to the control pressure duct 11 for high pressure.

In another position the main valve 8 guides, by means of a groove 17 situated in the middle, the space of the upper shoulder 2 into a connection with the high pressure ducts via a groove 18, and with the return ducts via a groove 19. The spindle of the main valve 8 is moved through the control pressure duct 11 by alternately connecting a high and low pressure to the space 20 at the end of the spindle. The other end of the main valve 8 spindle comprises a smaller space 21, which is continuously connected with the high pressure ducts by means of a duct 22 and the groove 18. The pressure space 20 of the spindle is closed with a small piston pin 23, which is larger than the piston pin 24 of the constant pressure space. When high pressure enters the space 20, the spindle of the main valve 8 moves to the left, as shown in FIG. 1, and opens, by means of the groove 17, a high pressure connection from the groove 18 to the groove 25, from which the high pressure is further supplied to the upper shoulder 2 of the piston via a duct 26. When the space 20 is connected to the low pressure line, the spindle of the main valve 8 moves to the right, as shown in FIG. 1, by the action of the high pressure prevailing in the space 21. In this position of the spindle of the main valve 8, the upper shoulder of the piston is connected to the return conduit 12 via the duct 26 and the grooves 25, 17 and 19. In the upper position of the piston, the high pressure is connected to the duct 11 and the main valve space 20 by means of the control pressure valve 9. The space 28 below the spindle 27 of the control pressure valve 9 is always acted upon by the high pressure which tends to lift the spindle and to form a connection between the grooves 14 and 15. Above the spindle 27 there is a space 29 comprising a pressure which is adjusted by pressure control valves 30 and 31, a shut-off means 32, and a remote control line 33 and control devices (not shown in the figures) installed therein. The remote control line 33 may both supply and remove the hydraulic fluid required in the adjustment. The remote control line 33 may also be completely plugged.

When the pressure of the percussion hammer in the high pressure line and in the chamber 28 reaches a pressure set in the chamber 29 (or by means of the chamber 29 in a certain structural sense), the spindle 27 forms the aforementioned connection from the duct 13 to the duct 11. The spindle 27 is opened by means of the pressure control valves 30 and 31 against the spring force of the valves 30 and 31 and the pressure of the air outside, and therefore the flow resistances in the return conduit 12 of the percussion hammer or the size of the piping do not affect the control pressure, and the operating pressure of the hammer remains in the set value. After each impact the piston 1 remains in the upper position in the manner described below, until the pressure accumulator 7 is sufficiently charged and the control pressure valve 9 opens to move the main valve 8 for a new impact. The spring force of the control valve 31 is adjusted to provide the percussion hammer with a minimum operating pressure, which is for example 30% lower than the maximum operating pressure adjusted with the control valve 30. This difference is achieved with various pressures and spring forces. If the shut-off means 32 is opened, the operating pressure is determined by the minimum pressure valve 31. When the shut-off means 32 is closed, the operating pressure of the percussion hammer is determined by the maximum operating pressure valve 30. The operating pressure may be separately adjusted continuously with the control line 33. The pressure surfaces of the spindle 27 may naturally be of different size, whereby the ratio between the control pressure and the operating pressure also changes.

In FIG. 2, the minimum pressure valve is replaced with a control means 35 positioned in the control pressure valve 9 and adjusted to provide the percussion hammer with a minimum operating pressure. The control means 35 may be a spring, as in FIG. 2, but it may also be another means intended for pressure control. The hydraulic fluid required in the control circuit is supplied from the high pressure line with a duct 34 which is in the spindle 27, but which may also be situated elsewhere. FIG. 2 shows the shut-off means 32 when it is open, whereupon the percussion hammer operates with a minimum pressure. It must be noted that even if the remote control line 33 were open and thus without pressure, the percussion hammer would operate with a minimum pressure.

In the embodiment of FIG. 2, the maximum operating pressure is formed by a hydraulic series connection through the following components: the spindle 27 (surface ratios), the control means 35, and the spindle and spring force of the valve 30. The shut-off means 32 and the remote control line 33 are hydraulically connected in parallel with the maximum pressure valve 30. Therefore the maximum operating pressure of the percussion hammer cannot be exceeded by means of the shut-off means 32 and the remote control line 33.

According to FIG. 2, a damping chamber, i.e. a brake 36, is provided in the upper position of the piston 1, since when the piston 1 moves in the impact direction, the high-pressure accumulator 7 is discharged more with small volume flows and the pressure drops lower in the upper shoulder 2 of the piston than with large volume flows. When the piston 1 is returning back to the upper position after the impact, the motion of the piston stops almost completely in the brake 36. Since the high-pressure accumulator 7 is not yet charged with small volume flows nor is the control pressure valve 9 open, the piston 1 keeps moving slowly upwards inside the brake 36.

When the pressure in the high-pressure accumulator 7 has risen, the control pressure valve 9 is open, and the main valve 8 has connected the high pressure to the piston upper shoulder 2, the piston 1 changes its direction of movement outwards from the brake 36. The brake 36 also retards the exit of the piston 1. With small volume flows the piston 1 manages to enter the brake 36 deeper in the return direction than with large volume flows, in which case the high-pressure accumulator 7 is charged faster. Therefore, the larger the volume flows, the faster the piston 1 also exits from the brake 36. When the piston 1 exits from the brake 36 slowly with small volume flows, the high-pressure accumulator 7 will be charged to excess, and the pressure on the upper shoulder 2 does not drop too low during the impact motion of the piston 1. The operation of the brake during the return movement of the piston 1 together with the above-described valves aiming at a constant pressure may be adjusted in such a way that with small volume flows the operating pressure of the percussion hammer will be higher than with large volume flows, so that the impact velocity and impact energy of the piston would remain constant regardless of the volume flow of the percussion hammer. The invention also comprises such a preferred dimensioning for the brake 36 in the upper end of the piston 1 that with small volume flows the impact velocity and impact energy of the piston are increased more than with large volume flows.

We claim:

1. A hydraulic percussion hammer comprising a piston, a pressure accumulator in a high pressure circuit, a main valve alternately conducting a high and low pressure to at least one pressure surface of the piston for making the piston move reciprocally, and a tool which the piston strikes, and, for the purpose of controlling the main valve, a control pressure valve which opens when pressure applied to one end of a spindle of the control pressure valve exceeds a set value, the control pressure valve being placed in such a way that the spindle of the control pressure valve is connected at said one end to the high pressure circuit of the hydraulic percussion hammer, and another end of the spindle of the control pressure valve comprises a control space connected through hydraulic ducts to at least two pressure control devices, for adjusting maximum and minimum operating pressures of the hydraulic percussion hammer.

2. A hydraulic percussion hammer according to claim 1, wherein the pressure control devices are connected hydraulically in parallel.

3. A hydraulic percussion hammer according to claim 1, wherein the pressure control devices are connected hydraulically in series.

4. A hydraulic percussion hammer according to claim 3, wherein a control means is placed in the control space of the control pressure valve to provide the percussion hammer with a minimum operating pressure when there is no pressure in the control space, and at least one other pressure control device is then connected in series with the control means.

5. A hydraulic percussion hammer according to claim 1, wherein the pressure control devices comprise a control device for setting a minimum and maximum pressure in the control space.

6. A hydraulic percussion hammer according to claim 1, wherein a remote control line is connected to the control space of the control pressure valve for continuously adjusting the operating pressure of the percussion hammer between the minimum and maximum operating pressures.

7. A hydraulic percussion hammer according to claim 1, wherein a duct leads from the high pressure circuit to the control space of the control pressure valve for supplying hydraulic fluid to the pressure control devices.

8. A hydraulic percussion hammer according to claim 7, wherein differences in temperature between the hydraulic fluid and the parts relating to the mechanism of percussion hammer can be eliminated by circulating the hydraulic fluid through the duct leading to the control space.

9. A hydraulic percussion hammer according to claim 1, wherein them spindle of the control pressure valve is adjusted to open a connection to the main valve when the piston is inside a hydraulic brake formed on an upper shoulder of the piston.

10. A hydraulic percussion hammer according to claim 9, wherein the hydraulic fluid flow in the upper shoulder of the piston is throttled by means of the hydraulic brake when the piston moves both up and down.

11. A hydraulic percussion hammer according to claim 1, wherein an opening of at least one of the pressure control devices connected to the control pressure valve can be adjusted by means of atmospheric pressure outside the percussion hammer.

12. A hydraulic percussion hammer having a first port for connection to a source of hydraulic fluid under pressure and a second port for connection to a low pressure space, the hammer comprising:

a piston having at least one pressure surface, a pressure accumulator connected to said first port, a main valve movable between a first position in which it connects the first port to said at least one pressure surface and a second position in which it connects the second port to said at least one pressure surface, whereby alternating movement of the main valve to its first and second positions causes the piston to move reciprocatingly, the main valve being biased toward its second position, a tool which the piston strikes when the piston moves under the influence of pressure connected to said one pressure surface when the main valve is in one of said first and second positions, a control pressure valve having a spindle movable between a first position in which the control pressure valve is operatively coupled to the main valve for causing the main valve to move from its second position to its first position and a second position in which the control pressure valve is operatively isolated from the main valve, and wherein the spindle has a pressure surface to which the first port is connected for urging the spindle toward its first position against a bias resistance, a pressure control means selectively operable for establishing either an upper bias resistance value or a lower bias resistance value for the control pressure valve and coupling the selected bias resistance value to the spindle.

13. A hydraulic percussion hammer according to claim 12, wherein the piston has a rest position and an impact position and is biased toward its rest position, and pressure applied to said at least one pressure surface of the piston urges the piston toward its impact position.

14. A hydraulic percussion hammer according to claim 13, wherein the spindle has a groove which connects the first port to a pressure surface of the main valve when the spindle is in its first position and the piston is in its rest position, for urging the main valve toward its first position, and the main valve has a groove which connects the first port to the pressure surface of the piston when the main valve is in its first position.

15. A hydraulic percussion hammer according to claim 14, wherein the piston has a land that cuts off the connection from the first port to the pressure surface of the main valve when the piston moves from its rest position toward its impact position.

16. A hydraulic percussion hammer according to claim 12, wherein the spindle has a groove which connects the first port to a pressure surface of the main valve when the spindle is in its first position, for urging the main valve toward its first position, and the piston has a groove that connects a second pressure surface of the main valve to the second port when the piston is in its impact position.

17. A hydraulic percussion hammer according to claim 12, wherein the pressure control means comprises a first pressure control device for establishing an upper pressure limit, a second pressure control device for establishing a lower pressure limit, the first and second pressure control devices being connected hydraulically in parallel between a second pressure surface of the spindle and a reference pressure, and a switch element for selectively isolating the second pressure control device.

18. A hydraulic percussion hammer according to claim 17, wherein the switch element is operative for selectively connecting or disconnecting the second pressure control device.

19. A hydraulic percussion hammer according to claim 12, wherein the pressure control means comprises a first pressure control device for establishing an upper pressure limit and a second pressure control device for establishing a lower pressure limit, the first and second pressure control devices being connected hydraulically in series.

20. A hydraulic percussion hammer according to claim 12, wherein the spindle has a second pressure surface and the pressure control means comprises a means for applying hydraulic pressure to the second pressure surface of the spindle for supplying said bias resistance, and the hydraulic percussion hammer includes a remote control line connected to the second pressure surface of the spindle for continuously adjusting the bias resistance between the lower and upper bias resistance values.

21. A hydraulic percussion hammer according to claim 12, wherein the spindle has a second pressure surface and the pressure control means comprises a means for applying hydraulic pressure to the second pressure surface of the spindle for supplying said bias resistance, and a duct connects the first port to the second pressure surface of the spindle for supplying hydraulic fluid to the pressure control means.

22. A hydraulic percussion hammer according to claim 12, comprising a static control device supplying a bias resistance urging the spindle toward its second position for establishing a minimum bias resistance valve for the control pressure valve, and the pressure control means comprises at least one pressure control device connected hydraulically in series with the static control device.

23. A hydraulic percussion hammer according to claim 22, wherein the static control device is a spring urging the spindle toward its second position.

24. A hydraulic percussion hammer according to claim 22, wherein the pressure control means further comprises a switch element for selectively isolating said one pressure control device.

25. A hydraulic percussion hammer according to claim 12, wherein the piston has a shoulder.

26. A hydraulic percussion hammer according to claim 25, wherein the hydraulic fluid flow in the upper shoulder of the piston is throttled.

27. A hydraulic percussion hammer according to claim 12, wherein the pressure control means includes at least one pressure control device having a pressure surface exposed to atmospheric pressure, whereby the bias resistance value established by said one pressure control device depends on ambient pressure.

* * * * *